US005361916A

United States Patent [19]

Pischke

[11] Patent Number: 5,361,916

[45] Date of Patent: Nov. 8, 1994

[54] GATE-HANDLING CRANE

[75] Inventor: David L. Pischke, Dousman, Wis.

[73] Assignee: Harnischfeger Corporation, Brookfield, Wis.

[21] Appl. No.: 118,598

[22] Filed: Sep. 10, 1993

[51] Int. Cl.[5] ..... B66C 1/38

[52] U.S. Cl. ..... 212/153; 294/82.31; 294/907; 405/106

[58] Field of Search ..... 212/153; 405/104, 105, 405/106; 294/907, 82.31

[56] References Cited

U.S. PATENT DOCUMENTS

| | | | |
|---|---|---|---|
| 2,125,928 | 8/1938 | Knerr | 405/106 |
| 2,130,354 | 9/1938 | Madsen | 405/106 |
| 2,169,316 | 8/1939 | Zwald | 405/106 |
| 2,335,272 | 11/1943 | Grunwell et al. | 405/106 |
| 2,718,320 | 9/1955 | Nelson et al. | 294/907 |
| 4,334,217 | 6/1982 | Nield et al. | 212/153 |

*Primary Examiner*—Michael S. Huppert
*Assistant Examiner*—Thomas J. Brahan
*Attorney, Agent, or Firm*—Jansson & Shupe, Ltd.

[57] ABSTRACT

Disclosed is a crane for moving an object such as a water dam gate having an attachment device, e.g., a hook, to be engaged by a hookup link. The link is mounted on the crane lifting block for link movement between a first position for engaging the gate hook and a second position for releasing the hook. Aspects of the invention involve a first apparatus for detecting when the link is within a predetermined location near the hook and a second apparatus for determining whether the link is in the first position or the second position. Other aspects of the invention involve a unique cable reel and link line arrangement whereby the hookup link is engaged or disengaged from the hook. A method for moving an object, e.g., a gate of a dam, is also disclosed.

8 Claims, 9 Drawing Sheets

FIG. 4
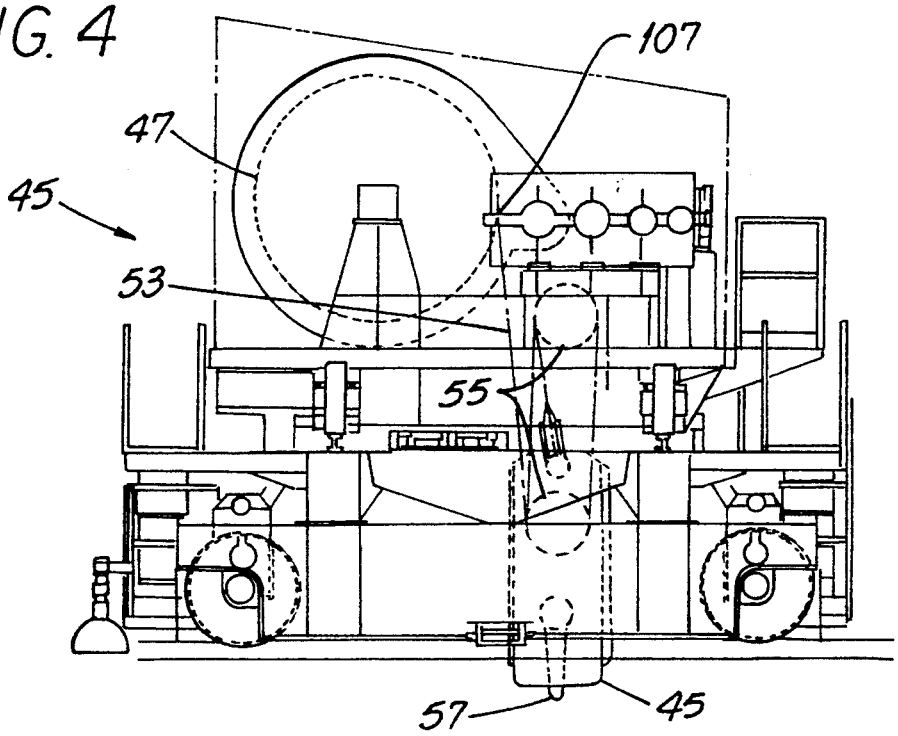
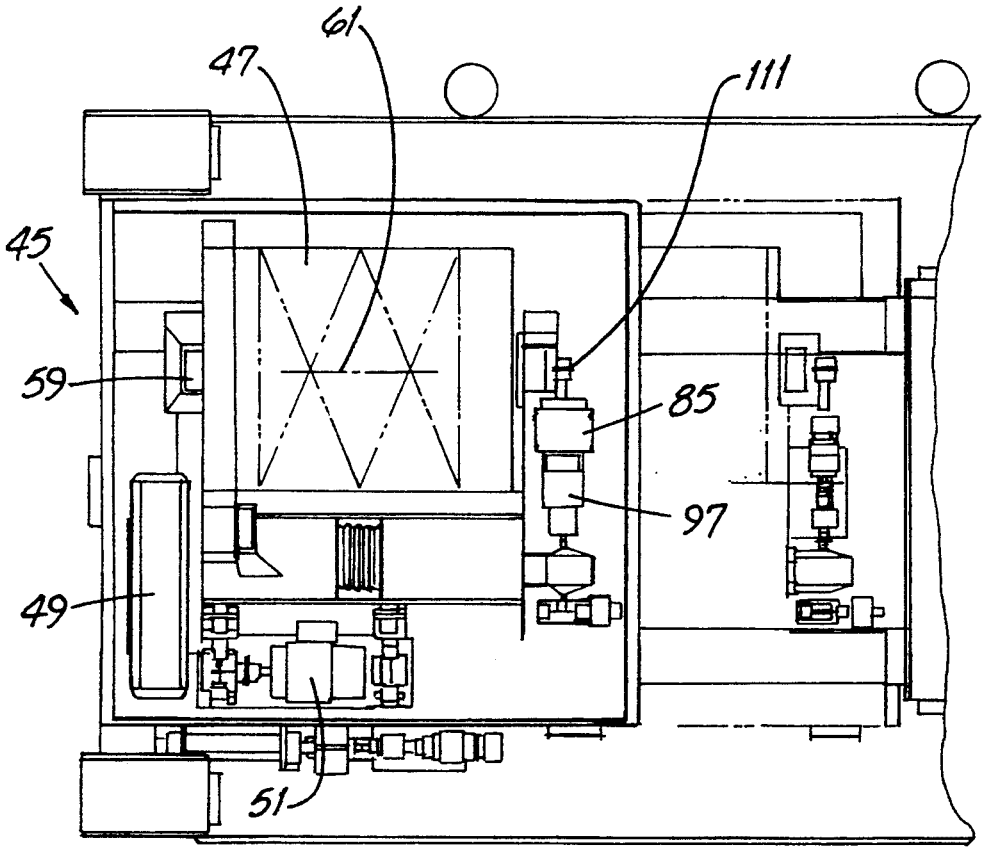
FIG. 5

GATE-HANDLING CRANE

FIELD OF THE INVENTION

This invention relates generally to material handling machines and, more particularly, to such machines such as cranes having traversing hoists.

BACKGROUND OF THE INVENTION

As the name suggests, material handling machines such as cranes (as well as excavators, loaders and shovels) are used to move material and objects from one place to another. Both the cranes themselves and the items handled by them can take any of a wide variety of forms. For example, material handled by such machines may include excavated soil, rock and (to cite a more unusual example) the water level control gates of a waterway dam.

Cranes are made in a variety of types including overhead travelling cranes (OTC) which run on elevated rails. Another type, described in connection with the invention, is a gantry crane. A gantry crane is a "stiff-legged" structure, the shape of which resembles an inverted "U." Such a crane has a generally horizontal frame arrangement supported at an elevation by side supports or "legs." The lower ends of the legs ride on rigid flanged wheels rolling atop spaced-apart railroad-like rails.

A gantry crane, like an OTC, has a movable trolley at the top of the inverted "U" and mounted on the trolley is a load-lifting hoist or, perhaps, two or more hoists. The wheels and rails supporting the lower ends of the crane legs are below the trolley and hoist apparatus, e.g., are at ground level or, as described below, are atop a water way dam. Such cranes are capable of picking up a load, e.g., a gate of a water way dam, raising it to an elevation and transporting the load to another location.

Since the invention is described in connection with a particular type of gantry crane used to place and remove gates in a large water way dam, the following discussion will be helpful in appreciating further details of such a gate-handling crane. Following this discussion, an explanation is provided as to some of the details of a water way dam and of the gates used therein.

Regarding a gate-handling crane, the rails supporting the crane legs are atop the dam and run generally parallel to the long axis of such dam. The crane has a powered bridge apparatus which spans and rides on rails atop the elevated horizontal portion of the crane. These bridge rails are oriented generally normal to the main crane rails; that is, the bridge rails are generally parallel to the direction of water flow. Thus, the bridge can be moved in an "upstream"or "downstream" direction.

Atop the bridge is a pair of trolleys riding on bridge-mounted rails. These trolley rails, like the main rails, run generally parallel to the long axis of the dam. While the trolleys are mechanically connected together so that they move in unison, the length of the connection can be readily changed.

Each trolley has a hoist apparatus comprising a cylinder-shaped, motor-driven hoist drum with many "wraps" of rope laid in a spiral groove formed in the drum. (Parenthetically, in practice, the "rope" used with such gantry cranes is braided wire and is referred to in the trade as wire rope.) In this specification, the strand-like component wound on the drum and used to raise and lower the block is referred to as "rope." The strand-like component wound on a separate cable reel and used to manipulate a link described below is referred to as a "link line" or simply a "line."

Suspended from the rope directly below the trolley is a lifting block having at least one (and usually several) pulley-like sheaves which guide the rope as the block is lifted and lowered by the driven, rotating drum. So that a load can be manipulated by the crane, the lifting block includes a pivot-mounted link having a pair of spaced arms and a link bar extending between the lower ends of such arms. The way in which the link attaches to or is detached from a dam gate is explained below.

An exemplary water way dam has a length of several hundred feet (motor vehicles are routinely driven atop it) and a height in the range of 60 to 100 feet. Formed in the dam are several vertical slot-like openings, each of which receives one or more gates for controlling the water flow rate. A gate is lowered into an opening to retard water flow and removed to increase such flow. In the exemplary dam, there are three gates, one atop the other, in each slot-like opening. Each gate may range in size from 15 to 30 feet in height and in excess of 10 feet in width and may weigh several dozen tons.

Near the extreme end of each gate top edge is a device such as a generally U-shaped hook for lifting and lowering the gate. In one arrangement, the open interior eye-like area of the hook faces upstream. When removing a gate, the crane is positioned over the opening and the trolleys are moved so that the lifting block of each is directly above a hook. For the reasons mentioned below, attaching the block-mounted link to the hook can be very difficult and "tricky."

One reason attachment is so difficult is that while the distance between the dam top and the hooks is known, the hooks are often under water and are not visible to the crane operator. In prior art cranes, a way the operator can judge the distance of the lifting block below the trolley is by watching tape marks on the hoist rope. Such marks are subject to being worn away and in darkness, they may be even less easily seen than in daylight.

The operator may also judge such distance (or, more accurately, judge when the link has contacted the hook) by watching when the hoist rope goes slack. But this technique may not be effective when the top edge of the gate is, say, 30 to 40 feet below the water surface. The water flow forces acting against the rope may prevent the rope from going visibly slack.

Yet another factor impairing link/hook engagement is that in a prior art crane, it is difficult to ascertain link pivot position even if the elevation of the block and link is correct for hookup. The link is pivot-mounted on the lifting block to move between an angled position (from which the link bar can approach and "swing into" the open hook interior) and a vertical position. In the vertical position, the link is either attached to the hook (if the link was at the proper hook-engaging elevation when pivoted to that vertical position) or it is not possible to attach to the hook until first moving the link to the angled, approach position.

Users of the crane find it necessary to position persons above the gate to manually manipulate push-pull "tether ropes" while "feeling" for the hook with the link. Such persons are directly above water and the operation is hazardous. And with the advent of the invention, it is unnecessary.

Yet another factor impairing link/hook engagement in a prior art crane is that as the link is pivoted in the block from its vertical to its angled position, the link is prevented from returning to vertical by a ratchet-and-pawl mechanism. Once the link attains the proper angled position (and assuming the link is at the proper elevation), a pin is manipulated to release the pawl and allow the link to swing to its vertical "hookup" position. The need for pin manipulation by "remote control" with ropes adds complexity to the operation.

The invention addresses these disadvantages in a unique and imaginative way.

OBJECTS OF THE INVENTION

It is an object of the invention to provide an improved gate-handling crane overcoming some of the problems and shortcomings of the prior art.

Another object of the invention is to provide an improved gate-handling crane capable of detecting when the lifting block and, particularly, the link is within a predetermined proximity to the gate hook.

Another object of the invention is to provide an improved gate-handling crane capable of determining when the link is in its first hook-engaging position or its second release position.

Yet another object of the invention is to provide an improved gate-handling crane which avoids the need to manually manipulate the link position.

Still another object of the invention is to provide an improved gate-handling crane which is devoid of a link ratchet-and-pawl mechanism and therefore, avoids the need to manipulate such a mechanism. How these and other objects are accomplished will become apparent from the following descriptions and from the drawing.

SUMMARY OF THE INVENTION

The invention involves a crane for moving an object such as a gate of a waterway dam. The object has a hook-like device to be engaged by a link pivot-mounted on the crane lifting block. The link is movable between a first position for engaging the device and a second position for releasing the device. The following summary first addresses some of the "logic" aspects of the crane and this is followed by a discussion of some details of the crane "hardware" or mechanical aspects. A method of moving the object is then briefly described.

Regarding some logic aspects of the invention, the improvement comprises a first encoder apparatus for detecting when the link is within a predetermined location, e.g., in sufficiently close proximity to the device that link/device hookup can be accomplished. There is also a second apparatus (which includes an encoding mechanism) for determining whether the link is in the first position, used to move the object, or the second position used preparatory to engaging the link with the device.

In the exemplary application of the crane, the device is below the surface of a body of water. Aspects of the invention involve electrical circuitry in that at least one and preferably both of the apparatus includes an electrical circuit. All components of such circuits are above the water surface to help avoid failure due to component leakage and the like.

The crane includes a rope drum and the hookup device is spaced from the drum, e.g., is well below the drum. Since the crane and its rope drum are at a fixed elevation, the distance between a point on the drum and the device is a known distance. The crane also includes a rope extending between the drum and the lifting block and an encoder driven in unison with the drum. The encoder provides a signal used for determining when the distance between the point and the link is substantially equal to the known distance. To put it another way, the signal is used to indicate when the link is positioned with respect to the hookup device so that link/device engagement can be accomplished.

The crane operator preferably should be informed when the link is so positioned. Therefore, the crane also includes an annunciator signalling when the length of the extending rope is substantially equal to the known distance.

The second apparatus (used in determining whether the link is in the first position or the second position) includes a link line attached to the link for moving the link. Such apparatus also includes an encoding mechanism permitting detection of relative movement of the link line with respect to the rope.

More specifically, the link line extends to the link from a rotating cable reel mounted on the crane near the rope drum. The encoding mechanism includes a first encoder (the encoder mentioned above) driven in unison with the drum and a second encoder driven in unison with the cable reel. The output of these encoders is compared and relative movement of the link line with respect to the rope is by detecting disparity of movement of the second encoder with respect to movement of the first encoder.

Some mechanical aspects of the crane will now be discussed. Cable reel torque (and, therefore, link line tension force) is provided by a torque drive attached to the cable reel. The torque drive applies torque to the reel in a direction tending to retrieve the link line onto the reel so that the link line is maintained taut. But since the cable reel is above the lifting block (which is suspended below the rope drum) and since the lifting block is quite heavy, the weight of such block "overcomes" the torque and link line pays out from the cable reel.

More specifically, the cable reel applies a first, reduced tension force or a second, higher tension force to the link line. When the first relatively low tension force is applied (merely to maintain the line taut, not to move the link), the link line moves at the same velocity as the lifting block. On the other hand, when the second higher tension force is applied to the link line, an abrupt, relatively strong upward "pull" is exerted on the link line for a brief time. As a result, the link line briefly moves at a velocity less than that of the lifting block. This activity moves the link to the second (i.e., open or release) position so that its link bar can engage the hookup device.

A method for moving an object such as a waterway gate dam will now be summarized. The method includes the steps of moving the lifting block to a position where the link is closely proximate the device. Preferably, this first moving step includes the step of actuating an annunciator when the link is closely proximate the device.

The link is moved from a first device-engaging position to a second position so that the link is disengaged from the device but in a position ready to engage the device. For such engagement, the link is then returned to the first position and the link bar moves into the open interior region or "eye" of the hook-like device and engages such device. The object is then lifted with the lifting block.

More specifically, the link is biased to the first position by a spring force and the second moving step includes overcoming the spring force. In one aspect of the method, overcoming the spring force includes the step of applying a tension force (the stronger second tension force mentioned above) to the link line.

In another variant aspect of the method, the device is hook-like and has a camming surface. Overcoming the spring force includes lowering the link along the camming surface and, in effect, the link is cammed to the second position by its own weight.

The link includes a lifting bar and in another aspect of the invention, the returning step includes lowering the lifting bar along the camming surface. The weight of the link and the action of the lifting bar sliding along the camming surface move the link toward the first or open position until the link bar "clears" the hook end of the device. The link bar is then urged into the interior region by the spring force and the object can then be moved. Other details of the invention are set forth in the following detailed description and in the drawing.

In the detailed description, mention is made of "torque" and "force." Torque is a force acting through a moment arm and tends to cause rotation. For example, a force of 10 pounds applied to a 12 inch long crescent wrench exerts torque of 120 inch-pounds on the nut engaged by the wrench. Force is an "agency" or "influence" acting in a straight line.

BRIEF DESCRIPTION OF THE DRAWING

FIG. 4 is an end elevation view of a trolley of the crane shown in FIGS. 2 and 3 and taken generally along the viewing plane 4—4 of FIG. 3. Surfaces of certain parts are shown in dashed outline.

FIG. 5 is a top plan view of the trolley shown in FIG. 4 taken generally along the viewing plane 5—5 of FIG. 2.

DETAILED DESCRIPTION OF PREFERRED EMBODIMENTS

Figure 1:
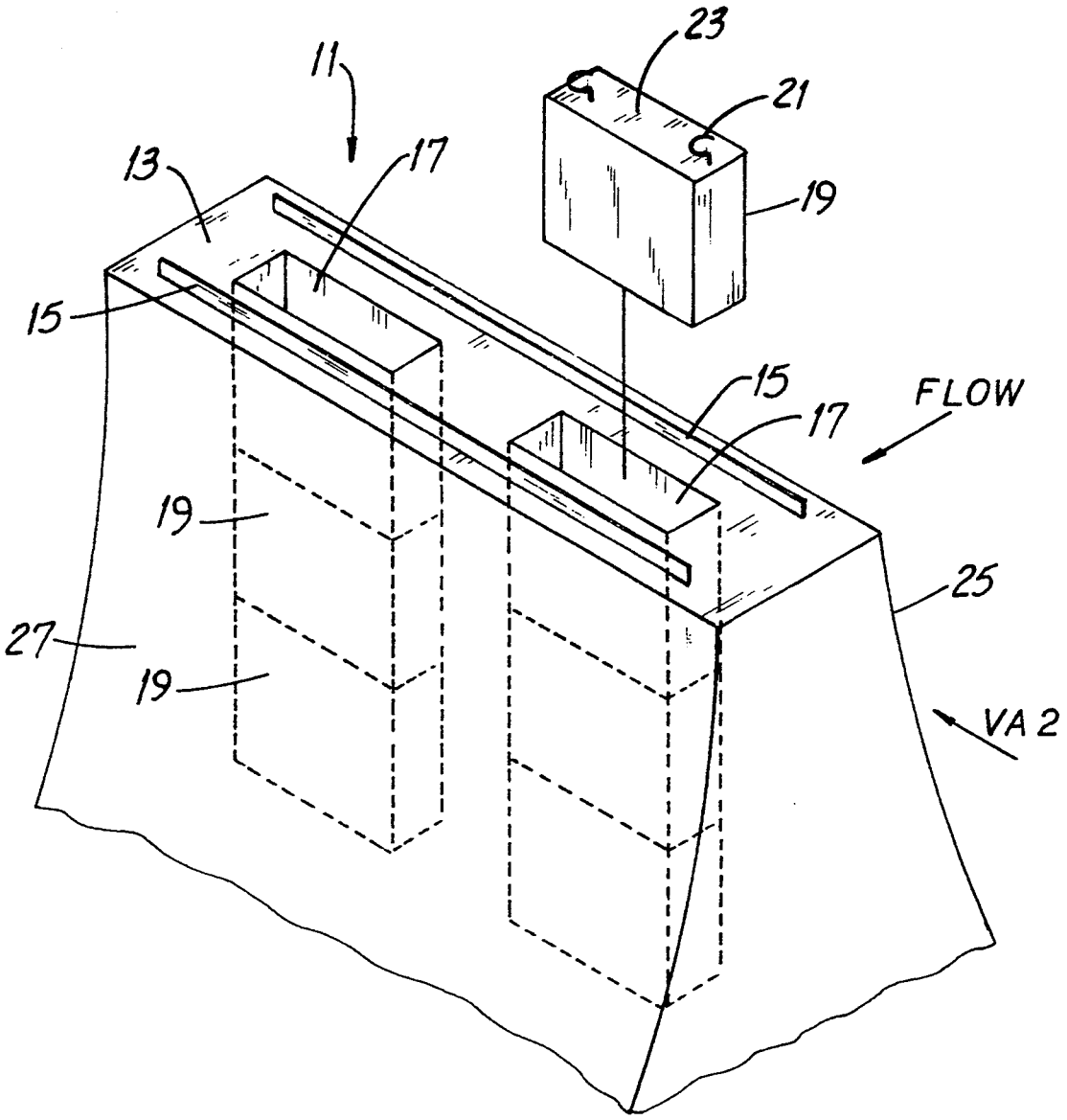
FIG. 1 is a representative perspective view of a water way dam with water control gates. Portions of gates are shown in dashed outline.

Before describing details of the inventive crane 10, brief explanations of its operating environment and of its general arrangement are set forth. FIG. 1 shows a representative dam 11 having a generally flat top face 13 on which is mounted spaced parallel rails 15 for supporting the crane 10. Extending generally vertically downward into the dam 11 are several slot-like openings 17, each retaining one or more water control gates 19. A representative gate 19 is shown separately and it is to be noted that each gate 19 has a hook-like device 21 near each outer end of the gate top 23.

In a manner not shown but well known, the dam 11 has large passages so that when a gate 19 is removed, water moves from the upstream side 27 to the downstream side 29, flowing through the space formerly occupied and closed by such gate 19. The gates 19 are placed and removed by the crane 10 which attaches to the devices 21 in a manner described below.

Figure 3:
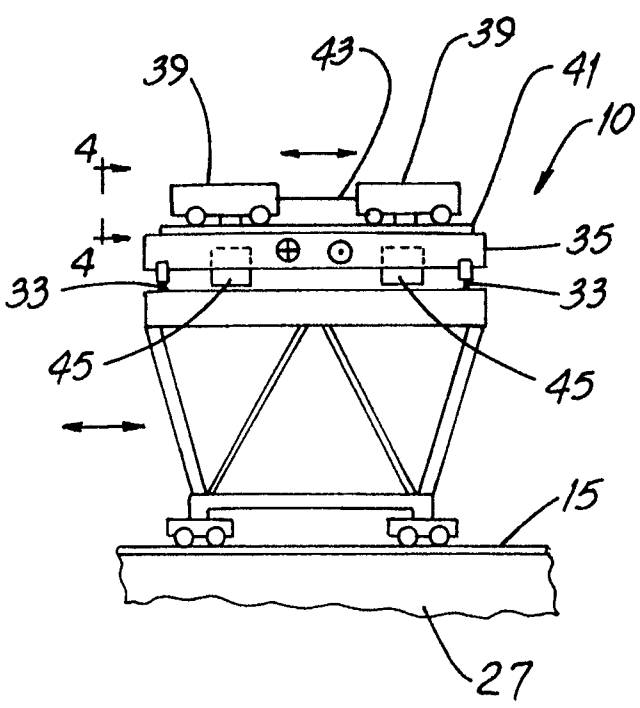
FIG. 3 is an elevation view of the crane shown in FIG. 2 taken generally along the viewing plane 3—3 thereof.
Figure 2:
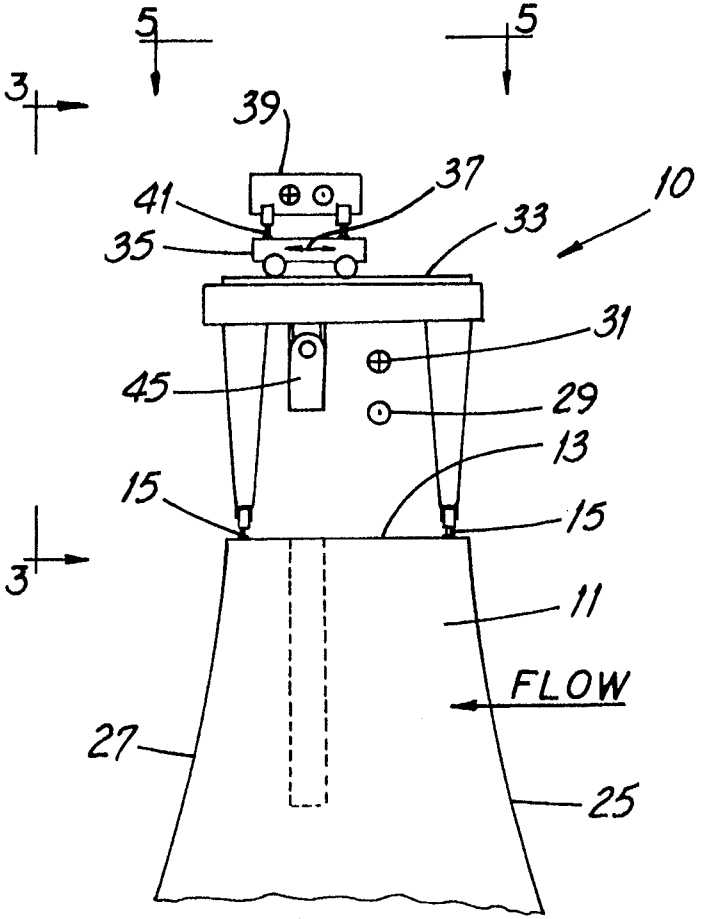
FIG. 2 is an end elevation view, taken generally along the viewing axis VA2 of FIG. 1, of the dam of FIG. 1 shown in conjunction with a simplified representation of a gate-handling crane atop the dam. A gate opening is shown in dashed outline.

FIGS. 2 and 3 show the gantry crane 10 riding on rails 15 atop the face 13 and crane movement is along the face 13 in directions represented by the arrow point end symbol 29, representing movement toward the viewer, and the feathered end symbol 31 representing movement away from the viewer. Both symbols 29, 31 are widely used and their meanings commonly understood. The crane 10 has a set of bridge rails 33 on which a bridge 35 moves in the directions represented by the double-ended arrow 37, i.e., in an upstream direction or a downstream direction.

Atop the bridge 35 is a pair of trolleys 39 moving on trolley rails 41. The trolleys 39 are linked together by a mechanical link 43 for movement in unison and the length of the link 43 can be changed as required. Like the crane 10 per se, the trolley 39 is capable of movement in the indicated directions, i.e., parallel to the top face 13 of the dam 11. From the foregoing, it is apparent that the crane 10 and, particularly, the trolleys 39 are capable of being precisely positioned so that the load-lifting block 45 of each is directly vertically above a gate hookup device 21.

Referring next to FIGS. 4 and 5, each trolley 45 includes a hoisting drum 47 powered through a geared speed reducer 49 by an electric motor 51. The drum 47 has grooves for accepting a single layer of rope 53 which is reeved over sheaves 55 for raising and lower the lifting block 45. As viewed in FIG. 4, clockwise drum rotation lowers the block 45. (After analyzing the specification in its entirety, the desirability of using but a single layer of rope will be apparent. One need not then complicate the control system to address the problem of differing effective drum circumferences.)

It is to be appreciated that in the exemplary embodiment, two trolleys 45 acting in unison are used to raise a single gate 19 with the lifting link 57 of each block 45 of each trolley 39 engaging a separate hookup device 21 on such gate. However, for ease of understanding, the following discussion is confined to the operation of a single trolley 39.

A first shaft encoder 59 is coupled to the drum 47 at a location coincident with the drum axis of rotation 61 and emits pulses or "counts" when the encoder 59 rotates. Such pulses (a predetermined number of which corresponds to one drum revolution) are used in a manner described below. Briefly explained, such pulses are used to determine how much rope 53 has been payed out from or retrieved onto the rotating drum 47 and, more particularly, such pulses are used to determine when the link 57 is at a predetermined elevation.

Figure 6:
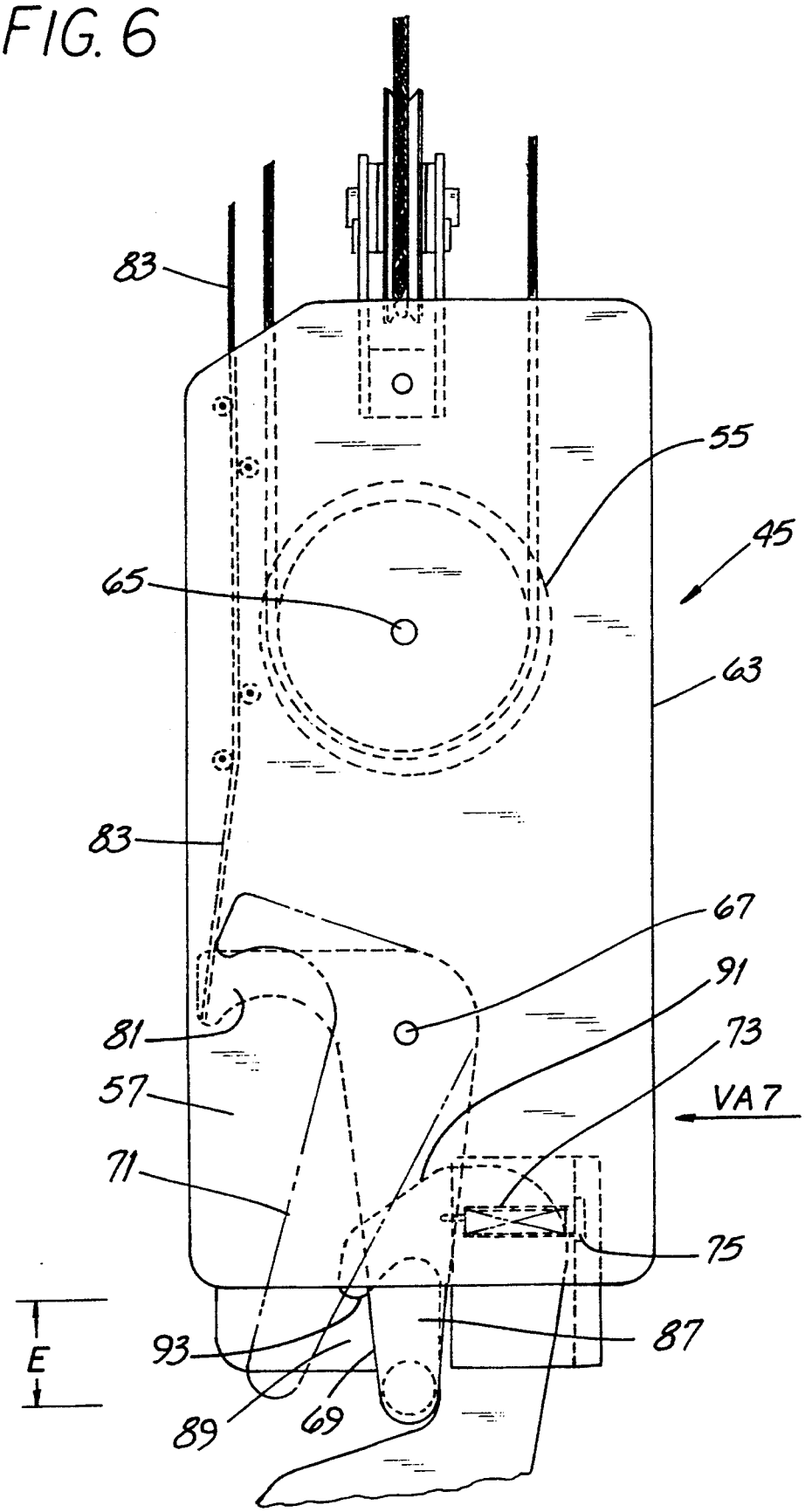
FIG. 6 is a side elevation view of a lifting block of the crane trolley shown in aforementioned FIGURES. Surfaces of certain parts are shown in dashed outline, the vertical position of the lifting link is shown in solid outline and the pivoted angle position of such link is shown in dashed outline.

Aspects of the lifting block 45 and its lifting link 57 will now be explained. As best seen in FIGS. 4 and 6, the block 45 has a pair of spaced side plates 63 which are generally flat and parallel to one another. Reeving sheaves 55 are mounted between the side plates 63 and rotate about the sheave axis 65.

A generally L-shaped lifting link 57 is mounted near the lower end of the block 45 between the plates 63 for pivoting movement about a pivot axis 67. The link 57 is capable of movement between a first generally vertical position, indicated by the solid outline 69, and a second angled position indicated by the dashed outline 71. The link 57 is spring-biased to the first position by a tension spring 73 coupled to an anchor 75 at one end and to the link 57 at its other end. The force exerted by such spring 73 is overcome in a way described below when hooking up to or detaching from a gate device.

Figure 7:
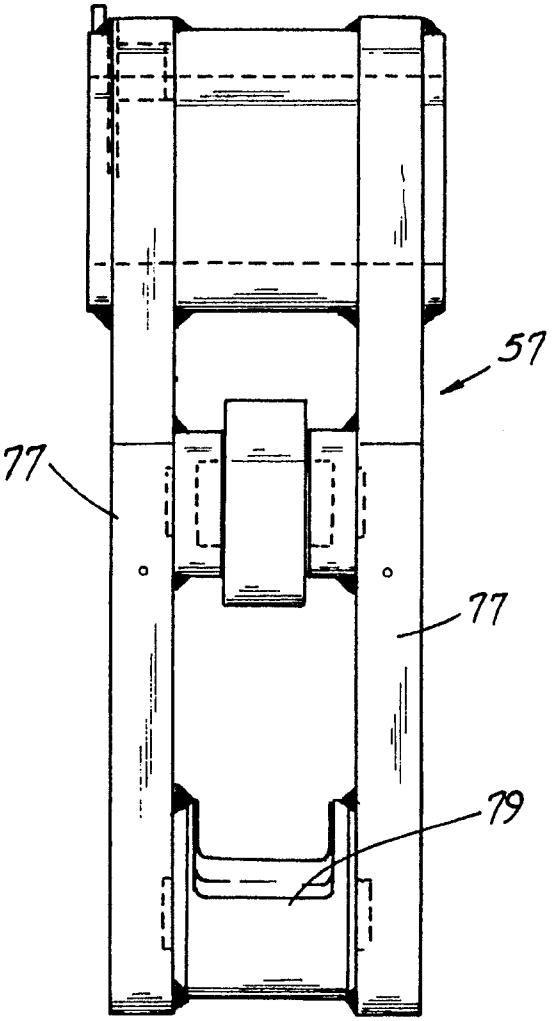
FIG. 7 is an elevation view of the lifting link shown in FIG. 6 and taken generally along the viewing axis VA7 in FIG. 6.

Considering FIG. 7 also, the link 57 has a pair of spaced, generally parallel lift members 79 spanned by a rigidly-attached link bar 79. It is the link bar 79 which engages a hook-like device 21 on a gate 19.

The link 57 also has a positioning arm 81 to which is attached a link line 83 maintained taut by a torque reel 85 described below. From FIG. 7 and the above explanation, it is apparent that if the link line 83 is pulled upward with sufficient force, it overcomes the force of the spring 73, the arm 81 pivots clockwise and the link 57 is pivoted to the second angled position.

It is also now apparent that attachment of the link 57 to the device 21 can occur if, and only if, (a) the block 45 and the link 57 are at the proper elevation with respect to the open interior region 87 and the eye 89 of the device 21, and (b) the link 57 is in the second angled position so that the bar 79 can swing into the region 87 under the urging of the spring 73 and after relaxing the tensioning force on the link line 83. In particular, the link bar 79 is preferably positioned within the depicted range of elevation "E" for attachment.

There are several instances in the attachment process during which the link 57 can be placed in the angled position. For example, the link 57 can be so placed at or near the start of block lowering or during block lowering and either of these is most preferred. Or the link 57 can be so placed after the block 45 has reached the proper elevation as indicated in a way described below.

And there are two ways of placing the link 57 in the second angled position preparatory to hookup. The link 57 can be moved by exerting a higher tension force on the link line 83 or even by merely lowering the block 45 (with the link 57 vertical) and allowing the bar 79 to bear against the cam-like surface 91 of the device 21. The latter technique urges the link 57 cam-like to the angled position as the link 57 is lowered. With this latter approach, which is less preferred, the link 57 will be urged by the spring 73 into the vertical position for gate pickup when the bar 79 "clears" the lower tip 93 of the hook.

From the foregoing, it is also apparent that if a gate 19 has been placed in the dam 11 and the link 57 is to be released from the device 21, it is not possible to effect such release unless the block 45 is in a position such that the link bar 79 can "clear" the lower tip 93 of the hook as the link 57 moves from the vertical position to the angled position. And, of course, even if the link bar 79 is at the proper elevation to clear the lower tip 93, no gate release can occur unless the link 57 is swung back to the angled position. This is best accomplished by exerting a higher tension force on the link line 83.

An explanation of how the link line 83 is controlled will now be provided. Referring additionally to FIGS. 5, 8, 9, and 12 the crane 10 also includes a grooved, drum-like torque reel 85 coupled to a variable torque unit 97. In a highly preferred arrangement, the unit 97 is a commercially-available type having a constant speed AC motor and an eddy current clutch. The output torque of the unit 97 is a function of the DC excitation of the clutch coil 99.

The link line 83 is wound on the reel 85, passes over a sheave 55 and extends downward to connect to the end of the arm 81. The unit 97 is mechanically coupled to the reel 85 and electrically connected in a way that its output torque always tends to retrieve the line 83, i.e., always pulls upward on such line 83. In a way explained in more detail below, the unit 97 is connected to provide either of two levels of output torque, i.e., higher and lower. The lower torque "setting" is used when raising and lowering the block 45 while the higher torque setting is used when shifting the position of the link 57 from the vertical position to the angled position.

Notwithstanding such upward "pull" provided by the lower torque setting (and the first, lower tension force resulting therefrom), the force resulting from the spring 73 is not overcome and the weight of the block 45 and the link 57 pays out the link line 83 from the reel 85 as the block 45 is lowered. Of course, such lower force also "takes up" and keeps the slack out of the link line 83 as the block 45 is raised.

To put it another way, the purpose of the lower tension force and the unit 97 is to maintain the line 83 taut and prevent it from becoming tangled with the rope 53 and sheaves 55 during hoisting and lower operations. And when the first tension force is applied, the link line 83 moves at the same velocity and in the same direction as the lifting block 45.

The way in which the lifting link 57 is pivoted from it first vertical position to its second angled position and the way in which the link 57 is attached to the device 21 will now be explained. For this part of the explanation, it is assumed that the crane operator wishes to attach the link 57 to a device 21 for lifting a gate 19. As the block 45 is being lowered, the torque unit 97 is switched to its "setting" which produces higher output torque and, therefore, a second higher tensioning force. Such force acting on the arm 81 is sufficient to overcome the bias force of the spring 73 and the link 57 is moved to its angled position.

It is to be noted that when the second tension force is applied, the link line 83 continues to move downward but it momentarily moves at a velocity less than that of the lifting block 45. It is this difference in velocity which causes the link 57 to pivot to its angled position.

When (by a technique described below) the link bar 79 is approximately aligned with the open interior region 87 of the hook 21, the unit 97 is switched back to its lower torque setting, the tensioning force on the link line 83 is reduced, the spring 73 overcomes such reduced tensioning force and urges the link 57 to its vertical position. The link bar 79 is then in the eye 89 of the hook 21 and raising the block 45 engages the bar 79 with the hook 21 and raises the gate 19.

The way in which the link 57 is detached from the hook 21 will now be explained. It is assumed that the crane operator now wishes to replace an earlier-removed gate 19 in an opening 17. The lower edge of the gate 19 is aligned with the opening 17 and, more specifically, with two upstream and two downstream vertical guide rails —not shown—within the opening 17 which guide the gate 19 as it is being lowered. It will be recalled that during lowering, the torque unit 97 is at its lower torque setting and the line 83 is merely maintained taut.

After the gate 19 has been lowered to its final position and after the block 45 comes to the proper elevation for unhooking (as indicated by an annunciator described below), the torque unit 97 is switched to its higher torque setting and the link 57 swings to its angled position or at least is urged to do so. If the link bar 79 is not then clear of the eye 89 and the tip 93 of the hook 21 (as it probably will not be), the block 45 is lowered slightly to permit the link 57 to swing as the bias force of the spring 73 is overcome and the bar 79 is disengaged from the hook 21. While retaining such higher torque setting, the block 45 is then hoisted until the link 57 is well clear of the hook 21. The unit is then returned to its lower torque setting and then the link 57 again swings to its vertical position.

Figure 11:
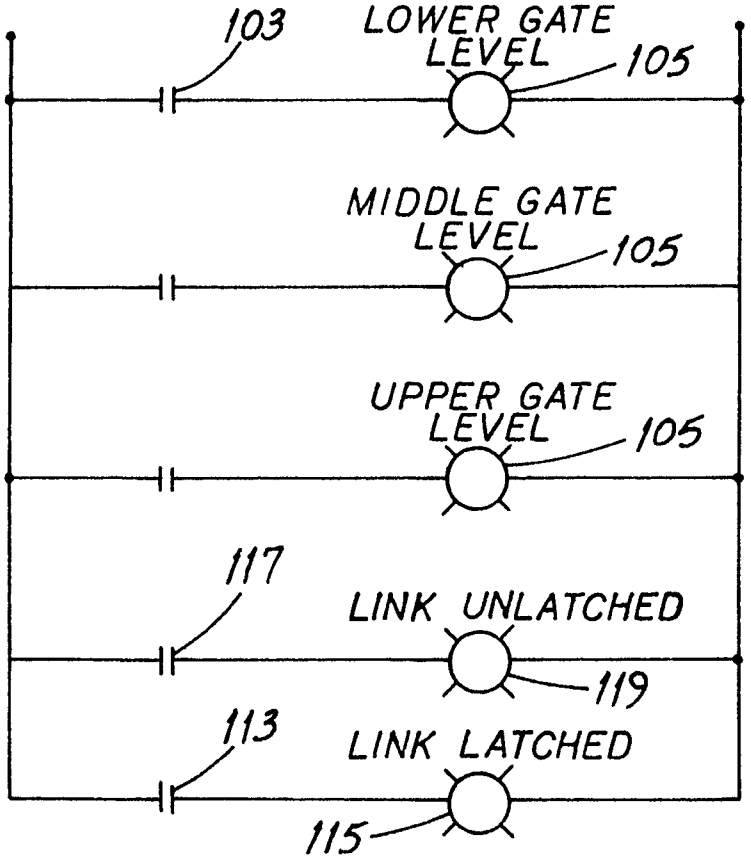
FIG. 11 is a circuit diagram showing aspects of the crane annunciator.
Figure 9:
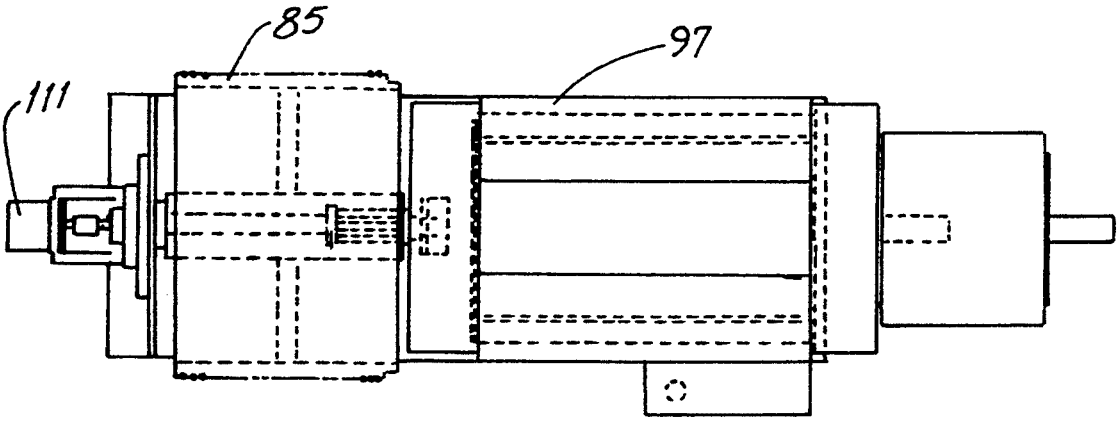
FIG. 9 is a top plan view of the trolley cable reel, adjustable torque unit and encoder.
Figure 8:
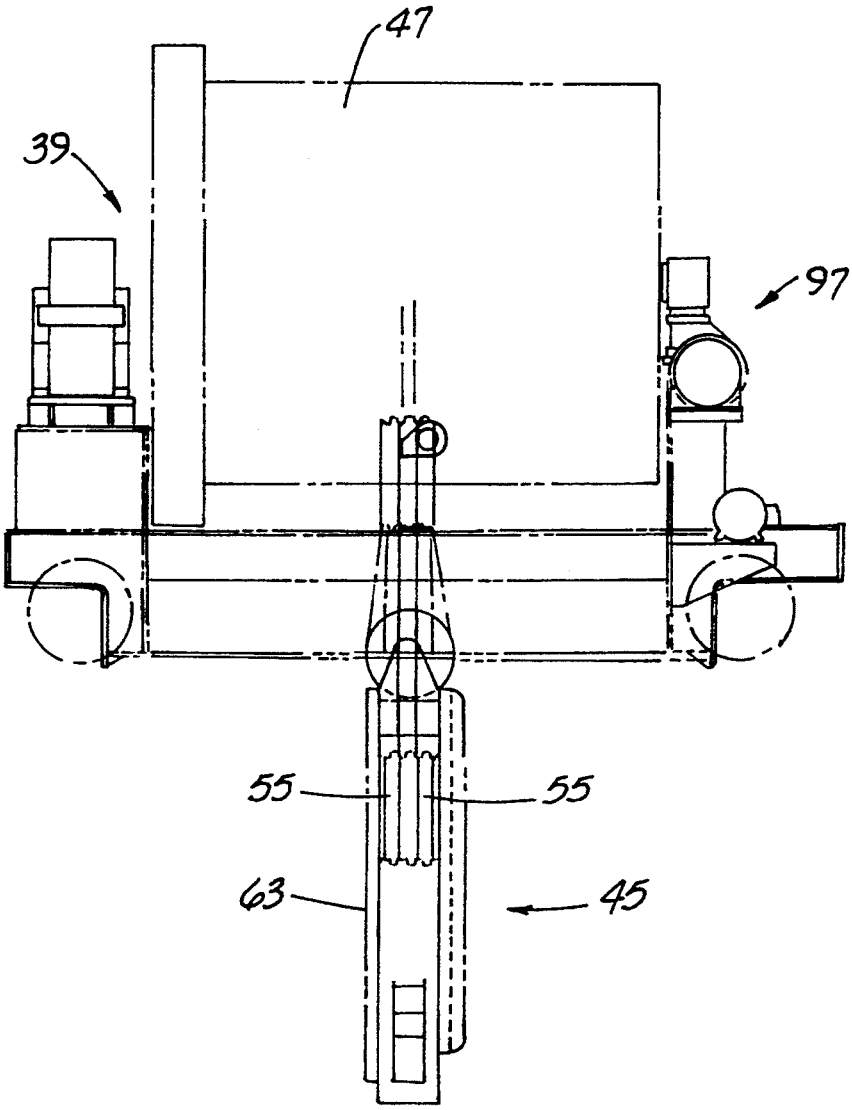
FIG. 8 is a simplified elevation view of a trolley and its lifting block.
Figure 10:
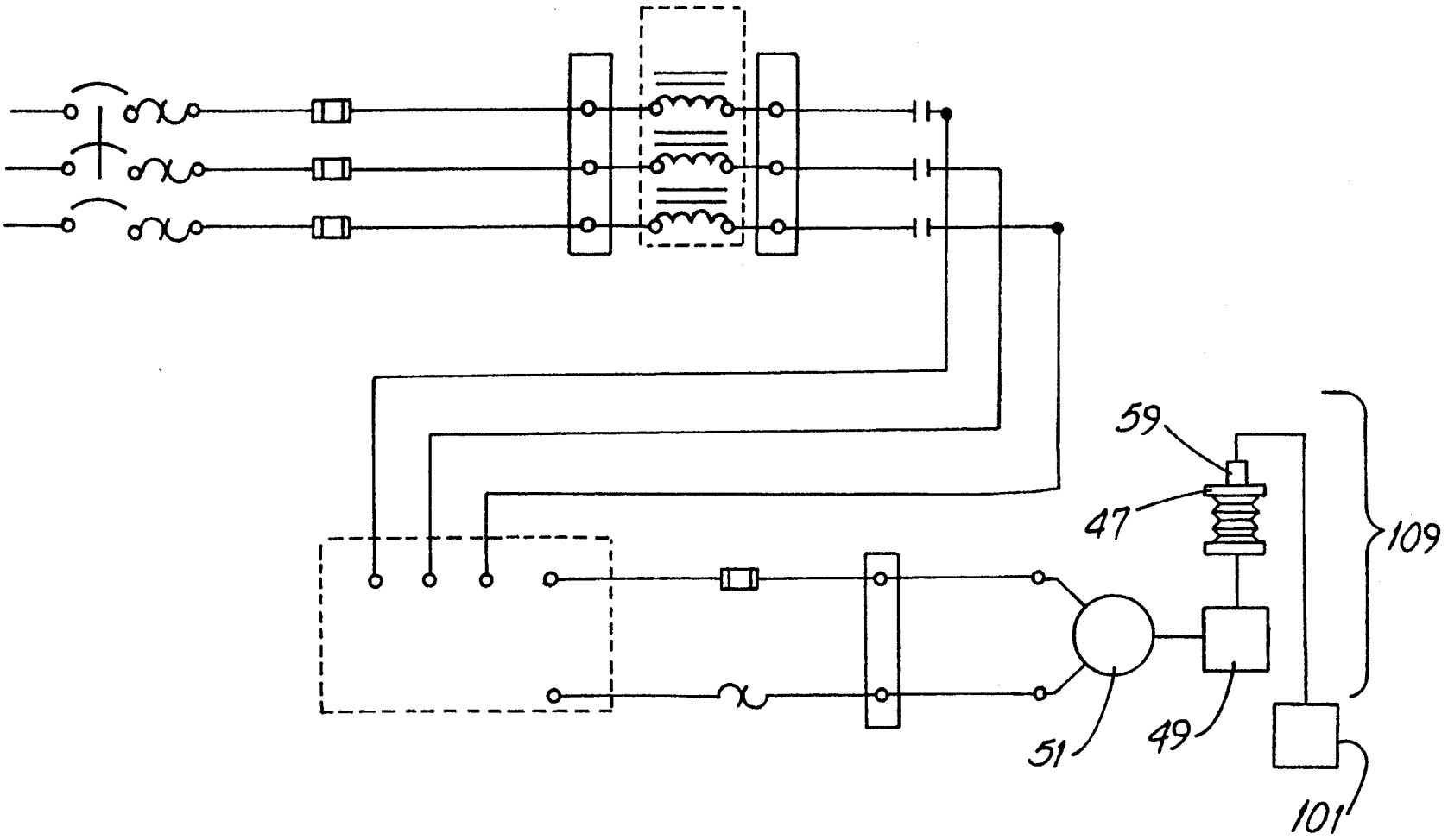
FIG. 10 is an electrical schematic diagram showing a trolley hoist drum drive motor, drum encoder and programmable logic controller.

The following is an explanation of the first apparatus for detecting when the link 57 is at a predetermined location and within close proximity to the device 21. Referring to FIGS. 4, 10 and 11, the drum 47 (and, effectively, the drive motor 51 rotating the drum) are mechanically coupled to a first encoder 59 which emits pulses or "counts" whenever the drum 47 rotates. And the number of pulses is proportional to the angle of rotation, whether a fraction of a revolution (e.g., 20°) or more. (Students of high school geometry will recall there are 360° in a circle, i.e., in one revolution.)

After appreciating the foregoing and the following, it will be understood that the required "resolution" of drum rotation is primarily a function of the mechanical arrangement of the link 57 and the hook 21. For example, it is assumed that the link 57 can be engaged with or disengaged from the hook 21 whenever the link bar 79 is within the elevation "E" as shown in FIG. 6. If the dimension of elevation "E" is, say, six inches, it is desirable to provide a signal to the operator when the center of the link bar 79 is about in the middle of such dimension to a "tolerance" of about one and one-half inches above and below such middle. This may suggest that a resolution of about one-half inch is desirable.

It is further assumed that an exemplary drum 47 is ten feet (one hundred twenty inches) in circumference. If only a single "part" of rope 53 is used, the encoder 59 preferably provides two hundred forty pulses for each drum revolution or one pulse for each one-half inch of rope payed out or retrieved. In the depicted embodiment of an actual crane 10 (having a drum circumference other than ten feet), an encoder providing 3600 pulses per drum revolution is used.

(As a practical matter, several "parts" of rope 53 are usually used on a crane such as crane 10 to obtain the requisite mechanical advantage with commensurate reductions in the rate at which the load is hoisted or lowered. For example, six parts of rope 53 may be used. The hoist drive then has the capability of lifting a load, the weight of which is nominally six times the "line pull" on a single part of rope 53. However, the rate at which such load is lifted is only one-sixth the linear rate at which the rope 53 is being payed out from or retrieved onto the drum 47.)

The pulses from the encoder 59 are directed to a programmable logic controller (PLC) 101 which counts pulses and provides an output signal (which is electrically equivalent to closing a contact 103) with the number of pulses is equal to a predetermined/preprogrammed number. Programming and the overall arrangement of the apparatus is in a way that when the number of counted pulses is equal to such predetermined number, the link bar 79 is within the elevation "E."

Contact closure illuminates an annunciator lamp 105 and provides a visual indication to the operator of that condition. In the exemplary dam 11 and crane 10, there are three such preprogrammed numbers and three such annunciator lamps 105, one corresponding to each of the three gates.

Considered another way, the first encoder 59 is in the nature of a measuring tape or ruler. It provides a way to measure (by counting the number of output pulses) the linear distance between any vertically-stationary point on the crane 10 preferably generally directly above the block 45 (such as the point 107 on the drum 47) and the link bar 79. Summarizing, the first apparatus includes the first encoder 59 and the PLC 101. An annunciator lamp 105 may also be considered a part of such apparatus.

The second apparatus for determining when the link 57 is in the first or vertical "latched" position or the second, angled "unlatched" position will now be explained. Referring again to FIG. 9 and, additionally to FIG. 12, the second apparatus includes an encoding mechanism comprising a first encoder 59 (that encoder 59 coupled to the drum 47) and a second encoder 111 coupled to the torque reel 95 which "handles" the link line 83.

Like the first encoder 59, the second encoder 111 provides output pulses which are directed to the PLC 101. Such pulses are emitted whenever the reel 95 rotates and the number of such pulses is proportional to the degrees of revolution of the reel 95. In a specific embodiment of the crane 10, the second encoder 111 also produced 3600 pulses per revolution of the reel. However, it will be appreciated from the foregoing that the number of pulses per revolution from the second encoder 111 may or may not be equivalent to that number for the first encoder 59.

It should also be appreciated that the reel 95 may or may not have the same circumference as the drum 47. In fact, coincidence of circumference would be unusual. But notwithstanding, the length of link line 83 payed out or retrieved for each revolution (or fraction thereof) of the reel 95 is readily computed and readily equated to a particular number of pulses emitted by the second encoder 111.

An example will help understand how relative movement of the link line 83 with respect to the rope 53 is detected. In this example, it is assumed that the link 57 is in the first, vertical position, the drum 47 is ten feet in circumference and the reel 95 is five feet in circumference. For ease of understanding, it will also be assumed that the block 45 is raised and lowered with a single part of rope 53. And it will be further assumed that the first encoder 59 and the second encoder 111 each emit 100 pulses per revolution of the drum 47 and the reel 95, respectively.

If the drum 47 rotates one-half revolution to lower the block 45, five feet of rope 53 pays out, the link 57 lowers five feet and the first encoder 59 emits 50 pulses. It will be recalled that prior to moving the link 57 to its second angled position for hookup, the line 83 is simply maintained taut and "follows" the hoist rope 53 and moves at the same velocity as the block 45 and, in this example, the same velocity as the hoist rope 53. In other words, there is no relative movement between the link line 83 and the block 45 and, in this example, between the link line 83 and the rope 53. Therefore, five feet of link line 83 also pays out (while such line 83 is maintained at relatively low tension), the reel 95 rotates one revolution and the second encoder 111 emits 100 pulses.

In this example, there are two pulses from the second encoder 111 for each pulse from the first encoder 59. The resulting ratio, 2:1 in this example, is programmed in the PLC and the number of pulses from the encoders 59, 111 are continuously compared. So long as such ratio is maintained, the PLC "signals" (by, effectively, maintaining the contact 113 closed and illuminating the annunciator lamp 115) that the link 57 is in the vertical position.

It is now assumed that the operator wishes to move the link 57 to its second, angled position preparatory to attaching the link 57 to the hook 21. The unit 97 is switched to its higher torque setting so that a second, higher tensioning force is exerted on the line 83. Such force is sufficient to overcome the bias force of the spring 73 and the link 57 pivots to its second position.

In so doing, the rate of movement of the link line 83 is temporarily slowed. Depending on the configuration of a specific crane 10, the line 83 may actually stop momentarily or even reverse direction momentarily. But for any of those eventualities, there is a momentary disparity of rotational movement of the second encoder 111 with respect to the first encoder 59 and, therefore, a momentary departure from the pulse ratio described above. The PLC detects this disparity and, by (effectively) opening the contact 113 to extinguish the lamp 115 and closing the contact 117 to illuminate the lamp 119, "signals" that the link 57 is now in the second, angled position.

After the link 57 attains such position, the pulse ratio is restored and the velocity and, if earlier changed, the direction of movement of the link line 83 then again becomes equal to that of the block 45. Notwithstanding, the lamp 119 is maintained illuminated (by circuitry not shown) until the link 57 is again restored to its vertical position.

Figure 12:
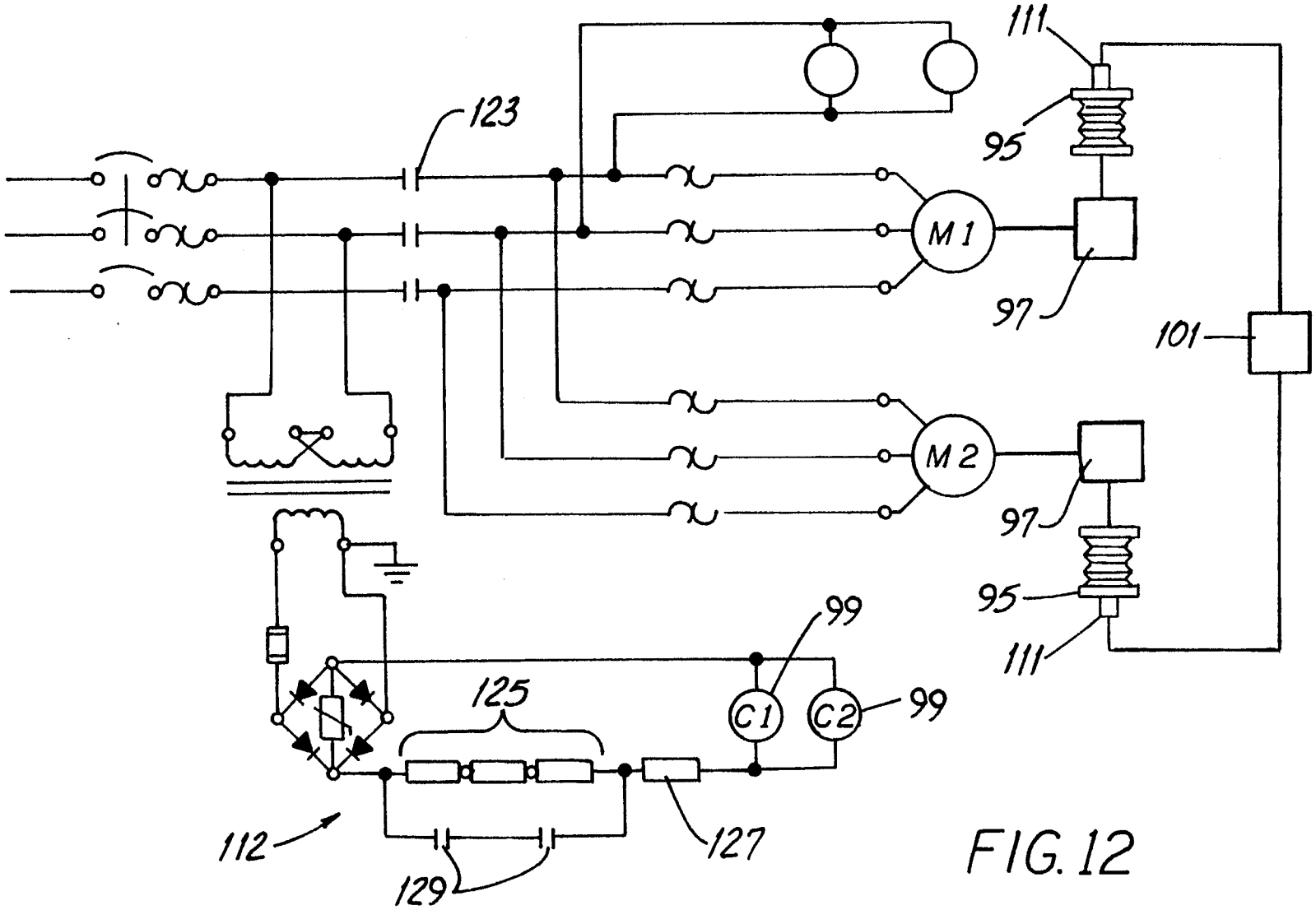
FIG. 12 is an electrical schematic diagram showing the drive motors and DC excitation coils of the eddy-current type adjustable torque unit shown in FIG. 9.

The circuit 112 controlling the "up-pulling" output torque of each of the two units 97 (one on each trolley 39) will now be explained. In FIG. 12, each torque unit 97 has an AC electric torque reel motor M1 or M2, respectively. The non-reversing motors M1, M2 run at constant speed whenever the line contactor 123 is closed.

Each motor is effectively coupled (through its respective reel 85) to a second encoder 111, the pulses of which are directed to a PLC 101. Each unit 97 has a clutch-like arrangement including a DC coil, the excitation current of which determines the torque applied by the motor M1 or M2 to a reel 85. It is to be recalled that motor rotation is in such a direction as to always apply "up" or tensioning torque to the reel 85 and, therefore, to always apply a tensioning force to the line 83 which, in the depicted embodiment, is upward.

The DC coils 99 are in parallel and coil excitation current is selected by appropriate resistors 125, 127 in series with the coil circuit. When the contacts 129 are open, the excitation current is relatively low and the first tensioning force on the line 83 is relatively low, about 10–15 pounds in a specific embodiment. On the other hand, when the contacts 129 are closed, the resistors 125 are shorted, the excitation current is higher and the second tensioning force on the line 83 is higher, about 40–50 pounds in the specific embodiment.

The contacts 129 are closed by the operator who depresses a button, switches a switch or the like (not shown) to energize a contactor. This activity is preferably performed before the block 45 is lowered or while it is lowering but before the block 45 and link 57 come into close proximity of the hook 21.

It is to be appreciated that notwithstanding the great accuracy and extreme ease with which the link 57 can be positioned relative to the hook 21 and latched to or unlatched from the hook 21, all electrical components and circuitry are above the surface of the water at all times. Such arrangement not only avoids component and connection leakage problems, it also avoids the possibility of underwater electrical components (which can be relatively delicate) from being struck and damaged by debris moving with the water. This is an enormous advantage which reduces maintenance cost and downtime. The depicted arrangement also avoid the necessity of exposing personnel to higher-risk situations over water as they were when using a prior art crane.

Figure 13:
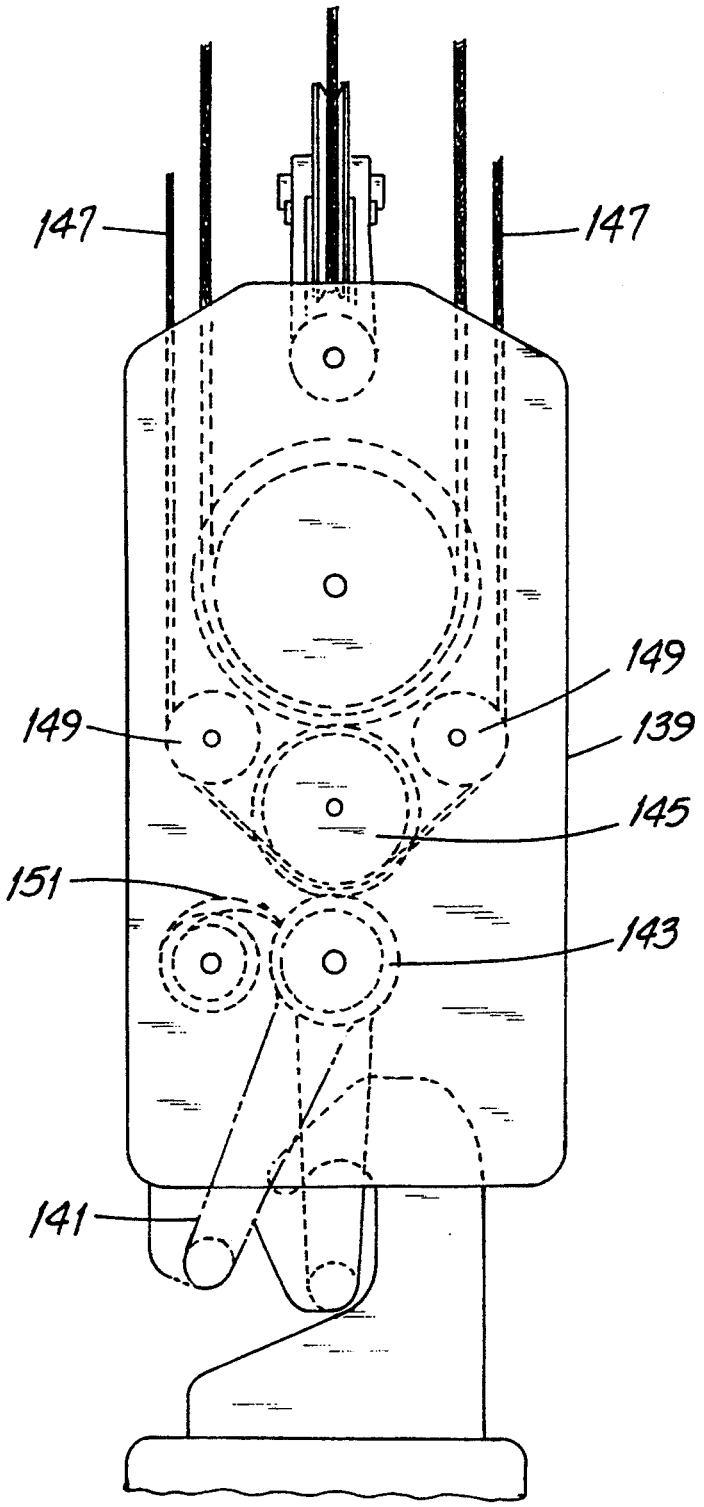
FIG. 13 PRIOR ART
FIG. 13 is a side elevation view of a prior art lifting block. Surfaces of certain parts are shown in dashed outline.

FIG. 13 shows a prior art block 139 and line link arrangement and helps appreciate why and how the invention crane 10 represents such a dramatic improvement. The link 141 is devoid of a positioning arm but, rather, has a driven gear segment 143 at its upper end. Such segment 143 engages gear teeth on a driving pulley 145, the rotational position of which is manipulated by a tiller rope 147 wrapped once or twice about the pulley 145 and extending upward around idler pulleys 149.

It was often necessary for workers standing atop the dam 11 to manipulate the tiller rope 147 strands up and down by hand (and while standing over open, fast-moving water) to swing the link 141. The arrangement has a ratchet-and-pawl 151 which engages a tooth of the segment 143 to hold the link 141 in an attained angled position. And the ratchet-and-pawl 151 can only be released by manipulating a separate pin, not shown.

While the principles of the invention have been described in connection with a few preferred embodiments, it is to be clearly understood that these are by way of example and are not limiting.

I claim:

1. In a crane for moving an object having an underwater device to be engaged by a link and wherein the link is mounted on the crane lifting block for link movement between a first position for engaging the device and a second position for releasing the device, and wherein link movement between positions is controlled by a tag line, the improvement comprising:

a first apparatus including (a) a first encoder emitting first pulses in response to movement of the lifting block, and (b) a controller detecting the first pulses for indicating when the link is within a predetermined location; and a second apparatus including a second encoder emitting second pulses in response to movement of the tag line, and wherein:

the controller also detects the second pulses and compares the first and second pulses for determining whether the link is in the first position or the second position.

2. The crane of claim 1 wherein:

the device is below the surface of a body of water;

at least one of the apparatus includes an electrical circuit; and, all components of the electrical circuit are above the water surface.

3. The crane of claim 2 wherein each apparatus includes an electrical circuit and all components of both electrical circuits are above the water surface.

4. The crane of claim 1 including a rope drum and wherein the device is spaced from the drum, the distance between a point on the drum and the device is a known distance and wherein the crane also includes:

the first encoder driven in unison with the drum and providing a signal used for determining when the distance between the point and the link is substantially equal to the known distance.

5. The crane of claim 4 including an annunciator signalling when the distance between the point and the link is substantially equal to the known distance.

6. The crane of claim 1 including a rotating rope drum and a rope extending between the drum and the lifting block and wherein the second apparatus includes:

a link line attached to the link for link movement; and, the first and the second encoders permitting detection of relative movement of the link line with respect to the rope.

7. The crane of claim 6 wherein:

the link line extends from a rotating cable reel to the link;

the first encoder is driven in unison with the drum and the second encoder is driven in unison with the cable reel; and, detection of relative movement of the link line with respect to the rope is by detecting disparity of movement of the second encoder with respect to movement of the first encoder.

8. The crane of claim 7 wherein the cable reel is above the lifting block and the weight of the lifting block pays out the link line from the cable reel.

* * * * *